US012344978B2

(12) United States Patent
Bagley

(10) Patent No.: US 12,344,978 B2
(45) Date of Patent: Jul. 1, 2025

(54) SEWING HOPPING FOOT WITH RULER GUIDE

(71) Applicant: GRACEWOOD MANAGEMENT, INC., West Jordan, UT (US)

(72) Inventor: Jim Matthews Bagley, West Valley City, UT (US)

(73) Assignee: GRACEWOOD MANAGEMENT, INC., West Jordan, UT (US)

( * ) Notice: Subject to any disclaimer, the term of this patent is extended or adjusted under 35 U.S.C. 154(b) by 0 days.

(21) Appl. No.: 18/550,782

(22) PCT Filed: Mar. 17, 2022

(86) PCT No.: PCT/US2022/071203

§ 371 (c)(1),
(2) Date: Sep. 15, 2023

(87) PCT Pub. No.: WO2022/198227

PCT Pub. Date: Sep. 22, 2022

(65) Prior Publication Data

US 2024/0158972 A1 May 16, 2024

Related U.S. Application Data

(60) Provisional application No. 63/162,064, filed on Mar. 17, 2021.

(51) Int. Cl.
*D05B 29/08* (2006.01)
*D05B 29/12* (2006.01)

(52) U.S. Cl.
CPC ..... *D05B 29/08* (2013.01); *D05B 29/12* (2013.01)

(58) Field of Classification Search
CPC ..... D05B 29/08; D05B 29/12; D05B 29/00; D05B 29/06
See application file for complete search history.

(56) References Cited

U.S. PATENT DOCUMENTS 1,934,190 A 11/1933 Harker
2,790,404 A 4/1957 Somers et al.
(Continued)

FOREIGN PATENT DOCUMENTS

CH 686681 A5 5/1996
DE 9405056 U1 5/1994
GB 2505152 A 2/2014
WO 2022198227 A1 9/2022

OTHER PUBLICATIONS

International Search Report and Written Opinion for International Application No. PCT/US2022/071203, dated Jun. 9, 2022, 13 pages.

(Continued)

*Primary Examiner* — Nathan E Durham
(74) *Attorney, Agent, or Firm* — Ryan L. Marshall; Jessica Kiser; Barnes & Thornburg LLP

(57) ABSTRACT

A hopping foot assembly for a sewing machine having a needle comprises a hopping foot base and a hopping foot arm. The hopping foot base is shaped to include a needle opening that extends axially therethrough relative to an axis. The hopping foot arm extends from the hopping foot base. The hopping foot arm is configured to be coupled to the sewing machine to fix the hopping foot base relative to the sewing machine.

17 Claims, 8 Drawing Sheets

(56) References Cited

U.S. PATENT DOCUMENTS

| | | | | |
|---|---|---|---|---|
| 4,665,845 | A * | 5/1987 | Card | D05C 15/20 112/80.4 |
| 5,513,586 | A * | 5/1996 | Neely | D05C 15/22 112/80.01 |
| 5,515,797 | A | 5/1996 | Janouschek et al. | |
| 8,234,989 | B2 | 8/2012 | Thomas et al. | |
| 8,453,587 | B2 | 6/2013 | Bagley | |
| 10,407,812 | B2 | 9/2019 | Labes et al. | |
| 10,612,173 | B2 | 4/2020 | Groelz et al. | |
| 2011/0100276 | A1 | 5/2011 | Thomas et al. | |
| 2019/0352824 | A1 | 11/2019 | Groelz et al. | |
| 2020/0109502 | A1 * | 4/2020 | Zieman | D05B 29/06 |
| 2020/0181820 | A1 | 6/2020 | Mitchell | |

OTHER PUBLICATIONS

International Preliminary Report on Patentability for International Application No. PCT/US2022/071203, dated Sep. 12, 2023, 8 pages.

Stormshopping; "Multifunctional Daisy Flower Stitch Circles Embroidery Presser Foot for Singer Brother Janome and Other Low Shank Sewing Machine by Stormshopping"; Retrieved from: https://www.amazon.com/Multifunctional-Circles-Embroidery-Presser-Stormshopping/dp/B072LW3W38 ; Available at least as early as Oct. 8, 2020; 9 pages.

Handi Quilter, Inc; "Handi Quilter Echo Feet Kit"; Retrieved from: https://www.amazon.com/Handi-Quilter-Echo-Feet-Kit/dp/B075R9MW5K ; Available at least as early as Oct. 8, 2020; 7 pages.

Brother; "Free Motion Echo Quilting Foot, Brother #XE0766001"; Retrieved from: https://www.sewingpartsonline.com/free-motion-echo-quilting-foot-brother-xe0766001.aspx?gclid=EAlalQobChMI26WQze-g7AlVjf7jBx1eBwSvEAQYBiABEgLGzvD_BwE on Oct. 6, 2020; 6 pages.

Johnson, Liz; "Janome Clear View Quilting Foot and Guide Set"; Retrieved from: https://sew4home.com/accessories-we-love-clear-view-quilting-foot-and-guide-set-from-janome/ ; Aug. 21, 2018; 15 pages.

Martelli Enterprises , "Bella Sedere—Presser Feet Demo", Retrieved from: https://www.youtube.com/watch?v=he-LlnlAoJQ, Uploaded Feb. 17, 2016.

* cited by examiner

SEWING HOPPING FOOT WITH RULER GUIDE

CROSS REFERENCE TO RELATED APPLICATIONS

This application is a National Stage application of International Application No. PCT/US2022/071203 filed 17 Mar. 2022, which claims priority to and the benefit of U.S. Provisional Patent Application No. 63/162,064, filed 17 Mar. 2021, the disclosure of which is now expressly incorporated herein by reference.

FIELD OF DISCLOSURE

The present disclosure relates generally to sewing or quilting machines, and more specifically to a hopping foot for sewing or quilting machines.

BACKGROUND

Sewing machines are used for stitching one or more pieces of fabric with thread. Some sewing machines are stationary such that fabric is feed under a needle of the sewing machine, while other sewing machines, like quilting machines, are maneuverable such that the needle may be moved across the fabric.

Maneuverable sewing machines allow a user to create intricate patterns with the stitching. Such sewing or quilting machines, however, may also make it difficult to accurately follow a path on the fabric, such as a seam, a ditch line, or another desired pattern.

A hopping foot and ruler may be used with the sewing machine to help guide the needle along the path. It remains difficult, however, to maneuver the machine and the ruler simultaneously.

SUMMARY

The present disclosure may comprise one or more of the following features and combinations thereof.

A hopping foot assembly for a sewing machine having a needle may comprise a circular hopping foot base, a hopping foot arm, and a rotating ruler guide. The circular hopping foot base may be shaped to include an outer surface and an inner surface that defines a needle opening that extends axially therethrough relative to an axis to allow the needle to extend into and out of fabric during use of the sewing machine. The hopping foot arm may extend axially from the hopping foot base relative to the axis. The hopping foot arm may be configured to be coupled to the sewing machine to fix the hopping foot base relative to the sewing machine. The rotating ruler guide may be coupled to the outer surface of the hopping foot base. The rotating ruler guide may be configured rotate about the axis relative to the hopping foot base.

In some embodiments, the rotating ruler guide may be configured to engage an edge of a ruler and rotate to maintain engagement with the edge of the ruler. The edge of the ruler may define a path. The rotating ruler guide may rotate to allow a user to follow the path with the needle of the sewing machine during use of the sewing machine.

In some embodiments, the rotating ruler guide may comprise a bearing and a guide attachment. The bearing may be coupled to the outer surface of the hopping foot base and may be configured to rotate about the axis. The guide attachment may be coupled to the bearing and may be configured to engage the edge of the ruler so as to align the needle with the path.

In some embodiments, the guide attachment may comprise a guide-attachment body and a plurality of guide-attachment tabs. The plurality of guide-attachment tabs may each extend from the guide-attachment body.

In some embodiments, the guide-attachment body may be shaped to include a top side surface, a bottom side surface, and a plurality of lateral edge surfaces. The bottom surface may be opposite the top side surface. The plurality of lateral edge surfaces may extend between and interconnect the top and bottom side surfaces. In some embodiments, the plurality of guide-attachment tabs may each extend from one of the plurality of lateral edge surfaces of the guide-attachment body.

In some embodiments, the bearing may include an outer race, an inner race, and a roller. The roller may be located between the outer race and the inner race.

In some embodiments, the hopping foot base may be coupled to the inner race of the bearing. The guide attachment may be coupled to the outer race of the bearing. In some embodiments, the guide attachment may be configured to couple to the edge of the ruler to fix the guide attachment relative to the ruler.

In some embodiments, the guide attachment may comprise a guide-attachment body, a guide-attachment clip, and a spring. The guide-attachment body may be coupled to the bearing. The guide-attachment clip may be coupled to the guide-attachment body and may be configured to pivot relative to the guide-attachment body about a pivot axis that is perpendicular to the axis. The spring may be located between the guide-attachment body and the guide-attachment clip and may be configured to bias the guide-attachment clip into engagement with the edge of the ruler.

In some embodiments, the guide-attachment clip may be shaped to define a groove. The groove may mate with the edge of the ruler to couple the rotating ruler guide to the ruler.

In some embodiments, the guide-attachment clip may include a pointer. The pointed may be configured to be aligned with measurement indicators formed in the ruler so that the user may sew a stitch in the fabric with a predetermined length.

In some embodiments, the rotating ruler guide may comprise a guide-attachment body. The guide-attachment body may be configured to engage the ruler so as to align the needle with the path. The plurality of guide-attachment tabs may each extend from the guide-attachment body.

In some embodiments, the guide-attachment body may be shaped to include a top side surface, a bottom side surface, and a plurality of lateral edge surfaces. The bottom side surface may be opposite the top side surface. The plurality of lateral edge surfaces may extend between and interconnect the top and bottom side surfaces. In some embodiments, the plurality of guide-attachment tabs may each extend from one of the plurality of lateral edge surfaces of the guide-attachment body.

In some embodiments, the rotating ruler guide may comprise a guide-attachment body, a guide-attachment clip, and a spring. The guide-attachment clip may be coupled to the guide-attachment body and may be configured to pivot relative to the guide-attachment body about a pivot axis that is perpendicular to the axis. The spring may be located between the guide-attachment body and the guide-attachment clip and may be configured to bias the guide-attachment clip into engagement with the edge of the ruler.

In some embodiments, the guide-attachment clip may be shaped to define a groove. The groove may mate with the edge of the ruler to couple the rotating ruler guide to the ruler.

In some embodiments, the rotating ruler guide may be configured to couple to the edge of the ruler. The rotating ruler guide may couple to the edge of the ruler to fix the rotating ruler guide relative to the ruler.

According to another aspect of the present disclosure, a hopping foot assembly for a sewing machine having a needle may comprise a hooping foot base, a hopping foot arm, and a rotating ruler guide. The hopping foot base may be shaped to include a needle opening that extends axially therethrough relative to an axis. The hopping foot arm may extend from the hopping foot base. The hopping foot arm may be configured to be coupled to the sewing machine to fix the hopping foot base relative to the sewing machine. The rotating ruler guide may be coupled to the hopping foot base. The rotating ruler guide may be configured rotate about the axis relative to the hopping foot base.

In some embodiments, the rotating ruler guide may be configured to engage an edge of a ruler that defines a path. The rotating ruler guide may rotate to maintain engagement with the edge of the ruler during use of the sewing machine.

In some embodiments, the rotating ruler guide may comprise a bearing and a guide attachment. The bearing may be coupled to the hopping foot base and may be configured to rotate about the axis. The guide attachment may be coupled to the bearing. The guide attachment may be configured to engage the ruler so as to align the needle with the path.

In some embodiments, the guide attachment may comprise a guide-attachment body and a plurality of guide-attachment tabs. The guide-attachment body may be coupled to the bearing. The guide-attachment body may be shaped to include a plurality of lateral edge surfaces. The plurality of guide-attachment tabs may each extend from one of the plurality of lateral edge surfaces of the guide-attachment body.

In some embodiments, the bearing may include an outer race, an inner race, and a roller. The roller may be located between the outer race and the inner race.

In some embodiments, the hopping foot base may be coupled to the inner race of the bearing. The guide attachment may be coupled to the outer race of the bearing.

In some embodiments, the guide attachment may comprise a guide-attachment body, a guide-attachment clip, and a spring. The guide-attachment body may be coupled to the bearing. The guide-attachment clip may be coupled to the guide-attachment body and may be configured to pivot relative to the guide-attachment body about a pivot axis that is perpendicular to the axis. The spring may be located between the guide-attachment body and the guide-attachment clip. The spring may be configured to bias the guide-attachment clip into engagement with the edge of the ruler.

In some embodiments, the guide-attachment clip may be shaped to define a groove. The groove may mate with the edge of the ruler to couple the rotating ruler guide to the ruler.

In some embodiments, the guide-attachment clip may include a pointer. The pointer may be configured to be aligned with measurement indicators formed in the ruler so that a user may sew a stitch in the fabric with a predetermined length.

In some embodiments, the guide attachment may be configured to couple to the edge of the ruler. The guide attachment may couple to the edge of the ruler to fix the guide attachment relative to the ruler.

In some embodiments, the rotating ruler guide may comprise a guide-attachment body and a plurality of guide-attachment tabs. The guide-attachment body may be configured to engage the ruler so as to align the needle with the path. The plurality of guide-attachment tabs may each extend from the guide-attachment body.

In some embodiments, the guide-attachment body may be shaped to include a top side surface, a bottom side surface, and a plurality of lateral edge surfaces. The bottom side surface may be opposite the top side surface. The plurality of lateral edge surfaces may extend between and interconnect the top and bottom side surfaces. In some embodiments, the plurality of guide-attachment tabs may each extend from one of the plurality of lateral edge surfaces of the guide-attachment body.

In some embodiments, the rotating ruler guide may comprise a guide-attachment body, a guide-attachment clip, and a spring. The guide-attachment clip may be coupled to the guide-attachment body. The guide attachment clip may be configured to pivot relative to the guide-attachment body about a pivot axis that is perpendicular to the axis. The spring may be located between the guide-attachment body and the guide-attachment clip. The spring may be configured to bias the guide-attachment clip into engagement with the edge of the ruler.

In some embodiments, the guide-attachment clip may be shaped to define a groove. The groove may mate with the edge of the ruler to couple the rotating ruler guide to the ruler. In some embodiments, the rotating ruler guide may be configured to couple to the edge of the ruler.

These and other features of the present disclosure will become more apparent from the following description of the illustrative embodiments.

DETAILED DESCRIPTION OF THE DRAWINGS

Figure 1:
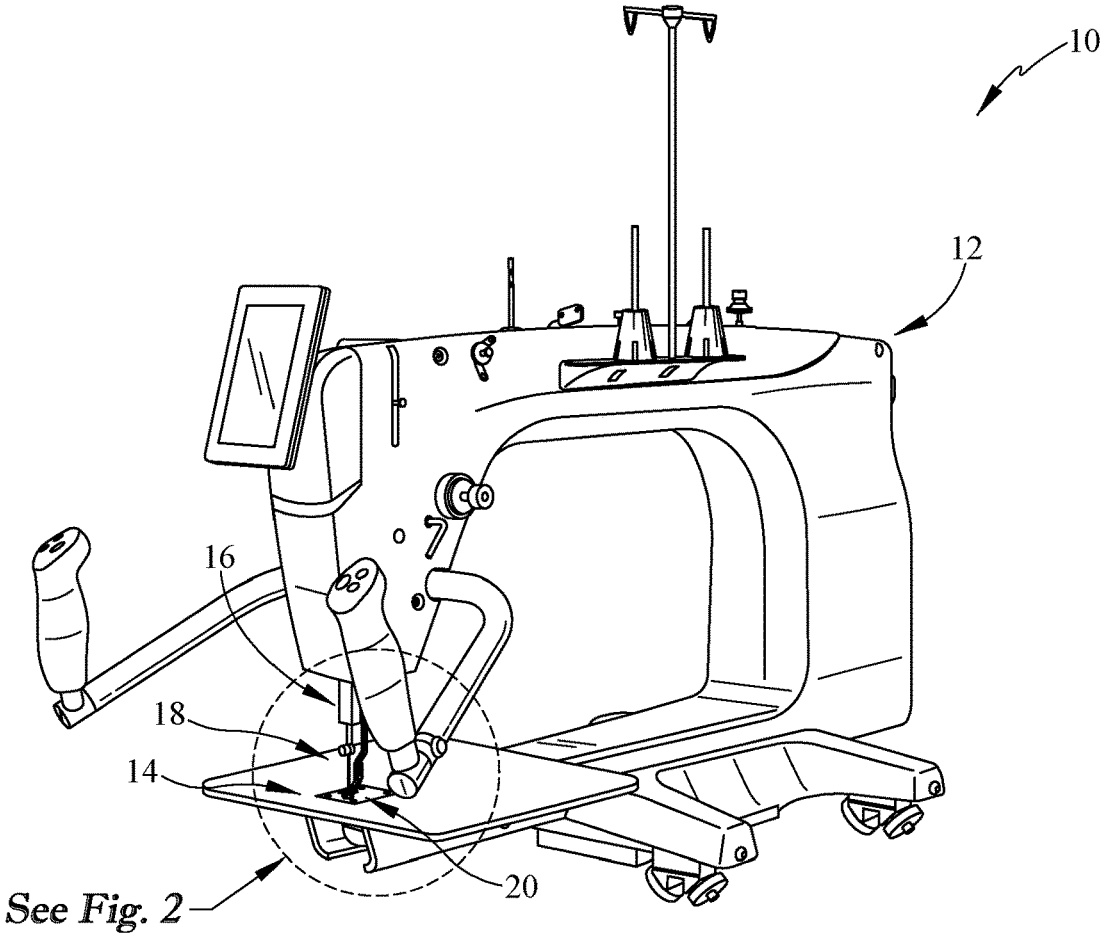
FIG. 1 is a perspective view of a sewing machine including a sewing machine body, a pressure bar, and a needle and showing a hopping foot assembly coupled to the presser bar of the sewing machine.

For the purposes of promoting an understanding of the principles of the disclosure, reference will now be made to a number of illustrative embodiments illustrated in the drawings and specific language will be used to describe the same.

Figure 2:
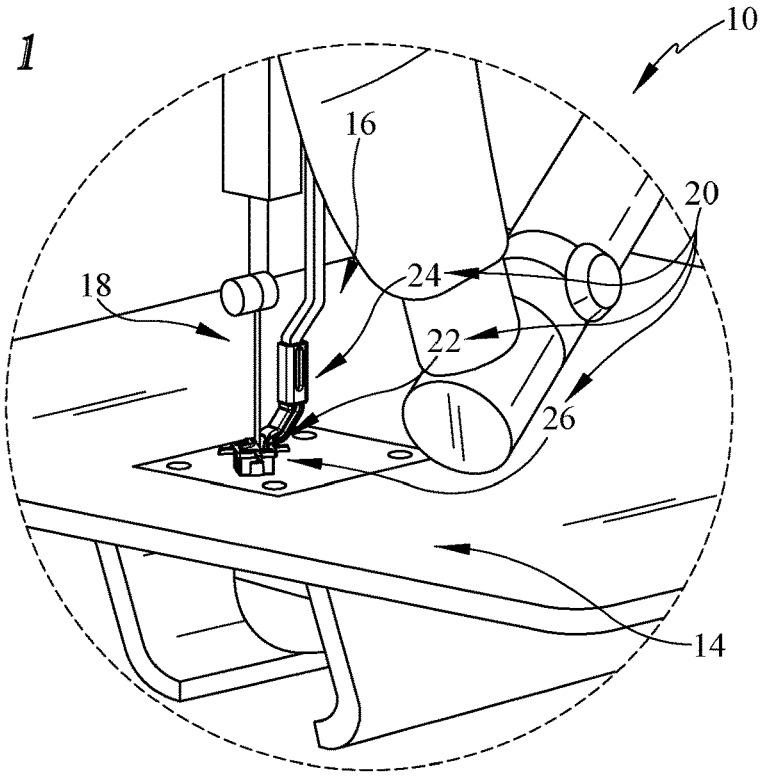
FIG. 2 is a detail view of the sewing machine of FIG. 1 showing the hopping foot assembly includes a hopping foot base shaped to include an needle opening that extends therethrough, a hopping foot arm that extends from the hooping foot base and fixes the hopping foot base relative to the sewing machine, and a rotating ruler guide coupled to the hopping foot base that aids a user in aligning a needle of the sewing machine in a path.
Figure 3:
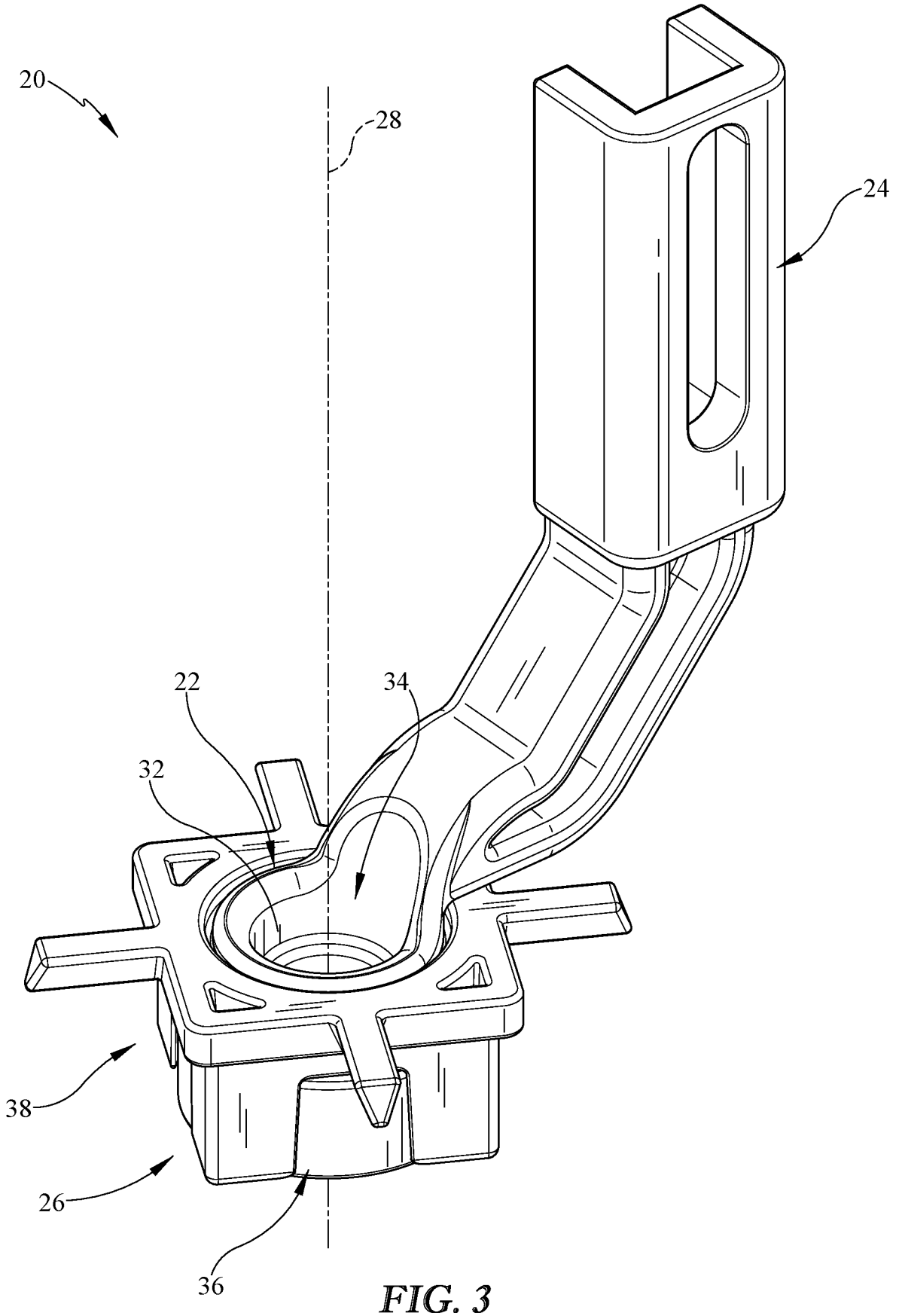
FIG. 3 is a perspective view of the hopping foot assembly of FIG. 2 showing the rotating ruler guide includes a bearing coupled to the hopping foot base that rotates about the axis of the hooping foot assembly and a guide attachment coupled to the bearing and configured to engage an edge of a ruler that defines the path so as to align the needle with the path.

A first embodiment of a hopping foot assembly 20 adapted for use with a sewing machine 10 is shown in FIGS. 1-7. The sewing machine 10 has a sewing machine body 12, sewing machine bed 14, a presser bar 16, and a needle 18 as shown in FIGS. 1 and 2. The hopping foot assembly 20 is coupled to the presser bar 16 of the sewing machine 10 and configured to be lowered into contact with fabric 19 to be sewn. A second embodiment of a hopping foot assembly 220 is shown in FIGS. 8-15.

The hopping foot assembly 20 includes a hopping foot base 22, a hopping foot arm 24, and a rotating ruler guide 26 as shown in FIGS. 2-7. The hopping foot base 22 is circular and shaped to define a needle opening 34 that extends through the base 22 relative to an axis 28. The needle opening 34 is configured to allow the needle 18 to extend into and out of the fabric 19. The hopping foot arm 24 extends axially from the hopping foot base 22 and couples to the presser bar 16 of the sewing machine 10 to fix the hopping foot base 22 relative to the sewing machine 10. The rotating ruler guide 26 is coupled to the hopping foot base 22 and is configured rotate about the axis 28 relative to the hopping foot base 22.

When sewing or quilting pieces of fabric together, it may be difficult for a user to guide the needle 18 of the machine 10 along a path without straying from the path. The path may be a seam, a ditch line, or another desired stitch pattern to be sewn in the fabric 19. Following the path with the needle 18 is especially difficult for free moving or maneuverable machines, which allow the user to freely move the machine 10 along the path.

Therefore, the user may use a ruler 15 to define the path to be followed by the needle 18 and help guide the hopping foot, and thus the needle 18, along the path. However, it may be difficult to maneuver the machine 10 and the ruler 15 simultaneously.

As such, the hopping foot assembly 20 includes the rotating ruler guide 26 to help the user easily guide the hopping foot assembly 20 along the ruler 15. The rotating ruler guide 26 is configured to engage an edge 17 of a ruler 15 that defines a path 21 and rotate to maintain engagement with the edge 17 of the ruler 15. Maintaining engagement of the hopping foot assembly 20 with the edge 17 of the ruler 15 is important for following the path 21 with the needle 18 during use of the sewing machine 10.

The rotating ruler guide 26 rotates to maintain engagement with the edge 17 of the ruler 15 to allow the user to easily maneuver the ruler 15 while operating the sewing machine 10. The ruler 15 may be moved around the hopping foot assembly 20 to create different paths 21 as suggested in FIGS. 5-7. The rotating ruler guide 26 may rotate as the ruler 15 is moved to maintain engagement with the ruler 15 so that the user does not need to reposition the hopping foot assembly 20 or the ruler 15.

Figure 5:
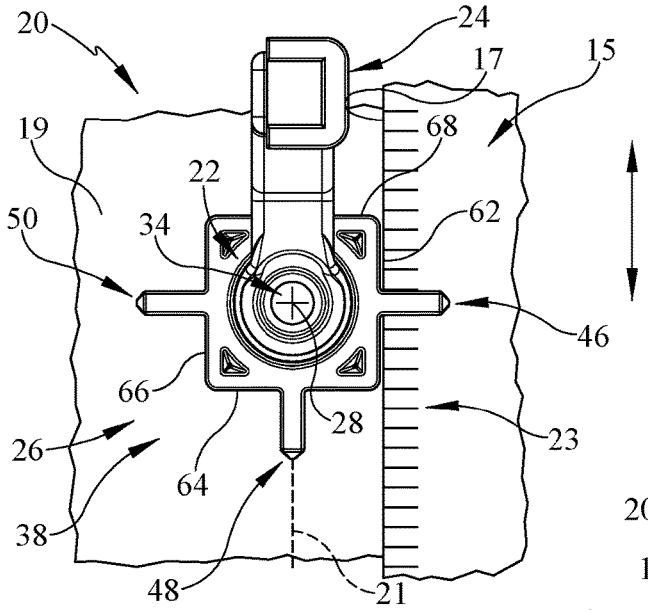
FIG. 5 is a top view of the hooping foot assembly of FIG. 3 showing the rotating ruler guide engaged with the edge of the ruler in a first position.
Figure 6:
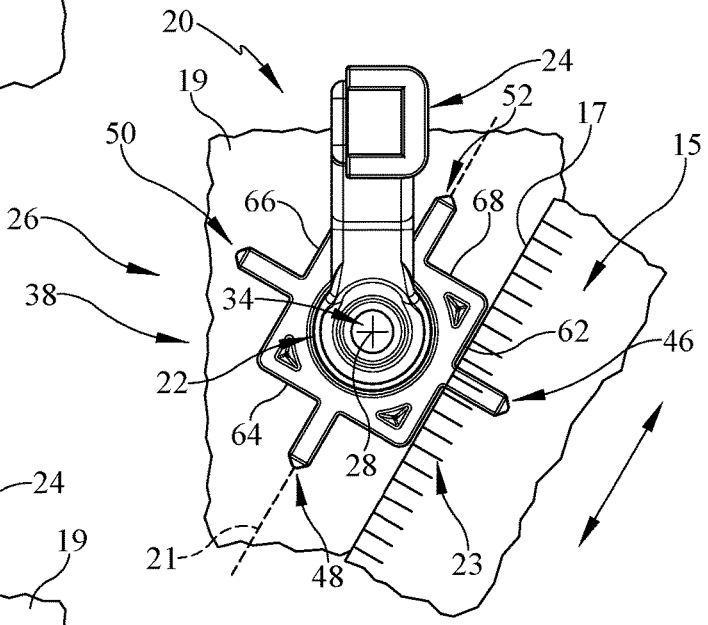
FIG. 6 is a view similar to FIG. 5 showing the rotating ruler guide engaged with the edge of the ruler in a second position which has caused the rotating ruler guide to rotate.
Figure 7:
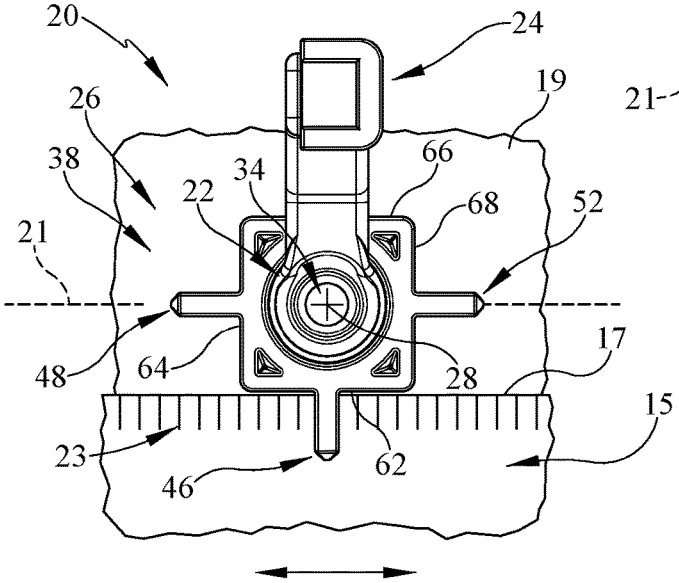
FIG. 7 is a view similar to FIG. 6 showing the rotating ruler guide engaged with the edge of the ruler in a third position which has caused the rotating ruler guide to rotate.
Figure 8:
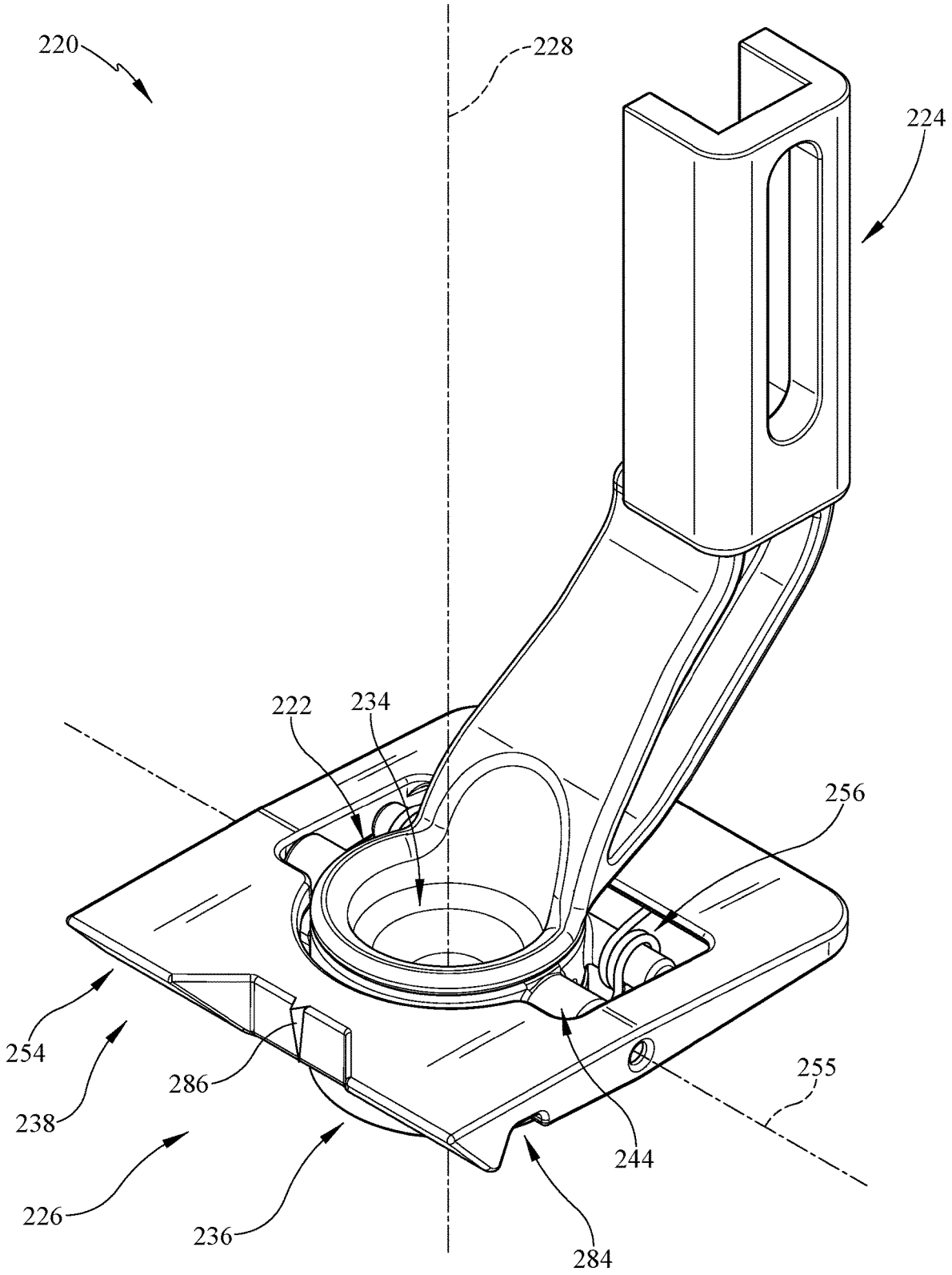
FIG. 8 is view of another embodiment of a hopping foot assembly showing the hopping foot assembly that includes a hopping foot base shaped to include a needle opening that extends therethrough, a hopping foot arm that extends from the hooping foot base and fixes the hopping foot base relative to the sewing machine, and a rotating ruler guide coupled to the hopping foot base that selectively couples to the ruler to aid the user in aligning the needle of the sewing machine in the path.

In an illustrative embodiment, the rotating ruler guide 26 offsets the needle 18 from the edge 17 of the ruler 15 as shown in FIG. 5-7. Therefore, the needle 18 follows the path 21 defined by the edge 17 of the ruler 15 at the offset distance from the edge 17 of the ruler 15. The path 21 may be a seam, ditch line, or other pattern line. In the illustrative embodiment, the edge 17 of the ruler 15 is straight and the path 21 is parallel to the edge 17 of the ruler 15. In other embodiments, the edge 17 may be curved or another non-linear path.

The rotating ruler guide 26 includes a bearing 36 and a guide attachment 38 as shown in FIGS. 3-7. The bearing 36 is coupled to the hopping foot base 22 and configured to rotate relative to the hooping foot base 22 about the axis 28. The guide attachment 38 is coupled to the bearing 36 and configured to engage the ruler 15 so as to align the needle 18 with the path.

Figure 4:
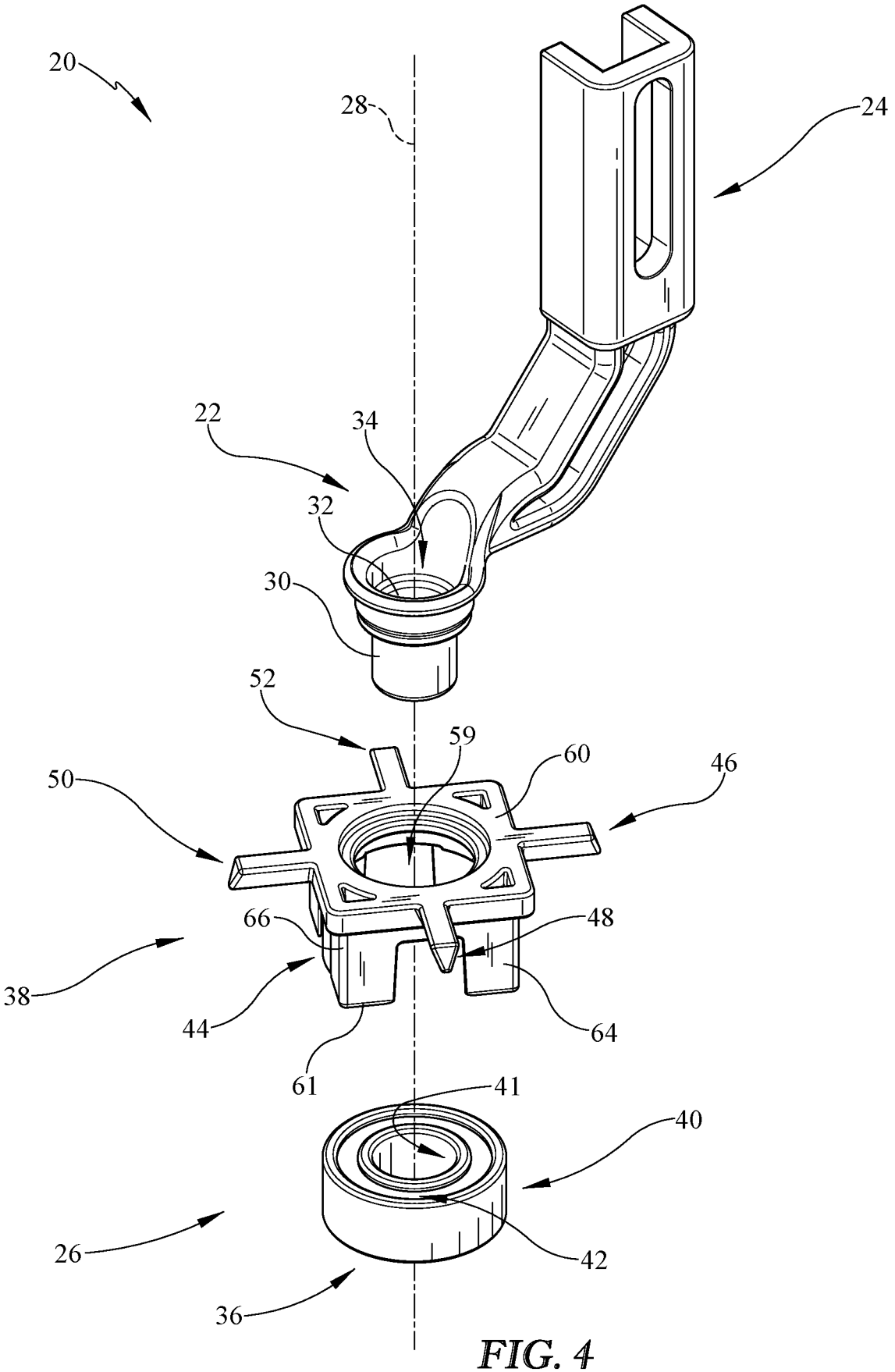
FIG. 4 is an exploded view of the hopping foot assembly of FIG. 3 showing the guide attachment includes a guide-attachment body that fits over the bearing and a plurality of guide-attachment tabs that each extend from different lateral edge surfaces of the guide-attachment body to help the user align the needle with the path.

The bearing 36 includes an outer race 40, an inner race 41, and a roller 42 as shown in FIG. 4. The roller 42 is located between the outer race 40 and the inner race 41. The hopping foot base 22 is coupled to the inner race 41 of the bearing 36, while the guide attachment 38 is coupled to the outer race 40 of the bearing 36.

The guide attachment 38 includes a guide-attachment body 44 and a plurality of guide-attachment tabs 46, 48, 50, 52 as shown in FIGS. 4-7. The guide-attachment body 44 is coupled and extends around the bearing 36. The guide-attachment tabs 46, 48, 50, 52 each extend from different lateral edge surfaces of the guide-attachment body 44.

The guide-attachment body 44 is shaped to include a top side surface 60, a bottom side surface 61, and a plurality of lateral edge surfaces 62, 64, 66, 68 as shown in FIGS. 4-7. The bottom side surface 61 is opposite the top side surface 60 and faces the fabric 19. The plurality of lateral edge surfaces 62, 64, 66, 68 extend between and interconnect the top and bottom side surfaces 60, 61.

The plurality of lateral edge surfaces 62, 64, 66, 68 include a first edge surface 62, a second edge surface 64, a third edge surface 66, and a fourth edge surface 68 as shown in FIGS. 4-7. The third edge surface 66 is opposite the first edge surface 62 and parallel to the first edge surface 62. The fourth edge surface 68 is opposite the second edge surface 64 and parallel to the second edge surface 64. The second and fourth edge surfaces 64, 68 extend between and interconnect the first and third edge surfaces 62, 66.

The plurality of guide-attachment tabs 46, 48, 50, 52 include a first tab 46, a second tab 48, a third tab 50, and a fourth tab 52 as shown in FIGS. 4-7. The first tab 46 extends from the first edge surface 62, while the third tab 50 extends from the third edge surface 66 in an opposite direction as the first tab 46. The second tab 48 extends from the second edge surface 64, while the fourth tab 52 extends from the fourth edge surface 68 in an opposite direction as the second tab 48.

The guide-attachment body 44 also defines a through hole 59 as shown in FIG. 4. The through hole 59 extends through the top side and bottom side surfaces 60, 61. The hopping foot base 22 extends into the hole 59 from the top side surface 60. The bearing 36 is coupled to the hopping foot base 22 in the hole 59 such that the guide-attachment body 44 extends around the bearing 36.

Turning again to the hopping foot base 22, the hopping foot base 22 includes outer surface 30, an inner surface 32, and the needle opening 34 as shown in FIGS. 4-7. The inner surface 32 is opposite the outer surface 30. The inner surface 32 defines the needle opening 34 that extends axially through the base 22. The inner race 41 of the bearing 36 is coupled to the outer surface 30 of the hopping foot base 22.

To use the hopping foot assembly 20, the user places the ruler 15 on the fabric 19 arranged on the machine bed 14 and engages one of the edge surfaces 62, 64, 66, 68 of the guide attachment 38 with the edge 17 of the ruler 15. The user then moves the sewing machine 10 along the path 21 while keeping the edge surface 62, 64, 66, 68 of the hopping foot assembly 20 engaged with the edge 17 of the ruler 15. In this way, the needle 18 follows the path 21 and stitches the desired stich line as suggested in FIGS. 5-7.

In the illustrative embodiment, the first edge 62 is engaged with the edge 17 of the ruler 15 in a first position as shown in FIG. 5. In the first position, the ruler 15 is extends vertically. The ruler 15 may be arranged on either side of the rotating ruler guide 26 in the vertical first position.

For instance, the ruler 15 may be arranged so that the third edge 66 of the guide attachment 38 may be engaged with the edge 17 of the ruler 15 while the ruler 15 is in the first position. Additionally, either one of the second or fourth edge surfaces 64, 68 may also be may be engaged with the edge 17 of the ruler 15 while the ruler 15 is in the first position. The rotating ruler guide 26 may be rotated until one of the edges 62, 64, 66, 68 engages the edge 17 of the ruler 15 in the first position.

In the illustrative embodiment, the first tab 46 extends over the ruler 15 and is configured to act as a pointer 46 as shown in FIGS. 5-7. The first tab 46 may be aligned with measurement indicators 23 formed in the ruler 15. The user may align the first tab 46 with the measurement indicators 23 of the ruler 15 to sew a stitch in the fabric 19 with a predetermined length.

Simultaneously, the second and forth tabs 48, 52 align with the path 21 as shown in FIGS. 5-7. The second tab 48 or the fourth tab 52 indicates the hopping foot assembly 20 is following the path 21 as the first tab 46 indicates the length of the stitch.

If the path 21 changes direction, i.e. the user wants/needs to sew a different seam, ditch line, or pattern line, the user may adjust the position of the ruler 15 as suggested in FIGS. 6 and 7. To adjust the position of the ruler 15, the user moves the ruler 15 keeping the edge 17 engaged with the edge surface 62, 64, 66, 68. The first edge surface 62 is kept engaged with the edge 17 of the ruler 15 as the position of the ruler 15 is adjusted in the illustrative embodiment. The ruler 15 is moved until the edge 17 of the ruler 15 defines the desired path 21 to be followed.

In the illustrative embodiment, the ruler 15 is moved from the first position to a second position as shown in FIG. 6. In the second position, the ruler 15 extends at an angle relative to the first position. The angle may vary as the rotating ruler guide 26 is configured to rotate 360 degrees about the axis 28. The first edge surface 62 remains engaged with the edge 17 of the ruler 15 in the second position as shown in FIG. 6.

In the illustrative embodiment, the ruler 15 may also be moved from one of the first position and the second position to a third position as shown in FIG. 7. In the third position, the ruler 15 extends horizontally. The ruler 15 may be arranged on either side of the rotating ruler guide 26 in the horizontal third position.

Another embodiment of a hopping foot assembly 220 in accordance with the present disclosure is shown in FIGS. 8-13. The hopping foot assembly 220 is substantially similar to the hopping foot assembly 20 shown in FIGS. 1-6 and described herein. Accordingly, similar reference numbers in the 200 series indicate features that are common between the hopping foot assembly 20 and the hopping foot assembly 220. The description of the hopping foot assembly 20 is incorporated by reference to apply to the hopping foot assembly 220, except in instances when it conflicts with the specific description and the drawings of the hopping foot assembly 220.

The hopping foot assembly 220 includes a hopping foot base 222, a hopping foot arm 224, and a rotating ruler guide 226 as shown in FIGS. 8-13. The hopping foot base 222 is circular and is shaped to define a needle opening 234 that extends through the base 222 relative to the axis 228. The needle opening 234 is configured to allow the needle 18 to extend into and out of the fabric 19. The hopping foot arm 224 extends axially from the hopping foot base 222 and couples to the presser bar 16 of the sewing machine 10 to fix the hopping foot base 22 relative to the sewing machine 10. The rotating ruler guide 226 is coupled to the hopping foot base 222.

In the illustrative embodiment, the rotating ruler guide 226 is configured rotate about the axis 228 relative to the hopping foot base 222. The rotating ruler guide 226 may rotate 360 degrees about the axis 228. The rotating ruler guide 226 is also configured to couple to the edge 17 of the ruler 15 aligned with the path 21 and rotate to maintain engagement with the edge 17 of the ruler 15.

The rotating ruler guide 226 includes a bearing 236 and a guide attachment 238 as shown in FIGS. 8-11. The bearing 236 is coupled to the hopping foot base 222 and configured to rotate relative to the hooping foot base 222 about the axis 228. The guide attachment 238 is coupled to the bearing 236 and configured to couple to the ruler 15.

Figure 9:
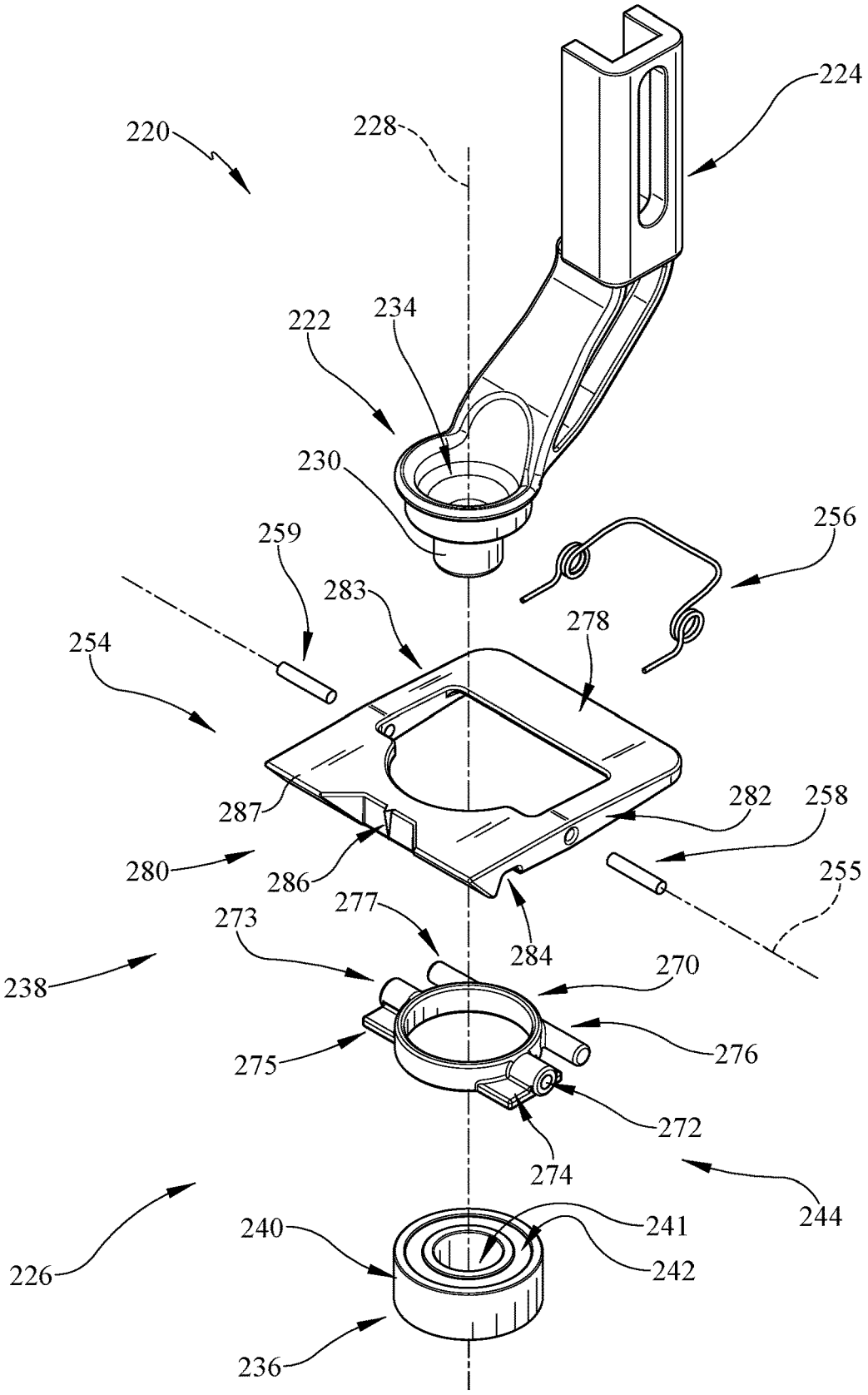
FIG. 9 is an exploded view of the hopping foot assembly of FIG. 8 showing the rotating ruler guide includes a bearing and a guide attachment configured to engage the ruler so as to align the needle with the path, the guide attachment having a guide-attachment body coupled to the bearing, a guide-attachment clip coupled to the guide-attachment body that that mates with the edge of the ruler to couple the rotating ruler guide to the ruler, and a spring located between the guide-attachment body and the guide-attachment clip that biases the guide-attachment clip into engagement with the edge of the ruler.

The bearing 236 includes an outer race 240, an inner race 241, and a roller 242 as shown in FIG. 9. The roller 242 is located between the outer race 240 and the inner race 241.

The hopping foot base 222 is coupled to the inner race 241 of the bearing 236, while the guide attachment 238 is coupled to the outer race 240 of the bearing 236.

The guide attachment 238 includes a guide-attachment body 244, a guide-attachment clip 254, and a spring 256 as shown in FIGS. 8-13. The guide-attachment body 244 is coupled to the outer race 240 of the bearing 236. The guide-attachment clip 254 is coupled to the guide-attachment body 244 and shaped to define a groove that mates with the edge 17 of the ruler 15 to couple the rotating ruler guide 226 to the ruler 15. The spring 256 is located between the guide-attachment body 244 and the guide-attachment clip 254 and configured to bias the guide-attachment clip 254 into engagement with the edge 17 of the ruler 15.

Figure 10:
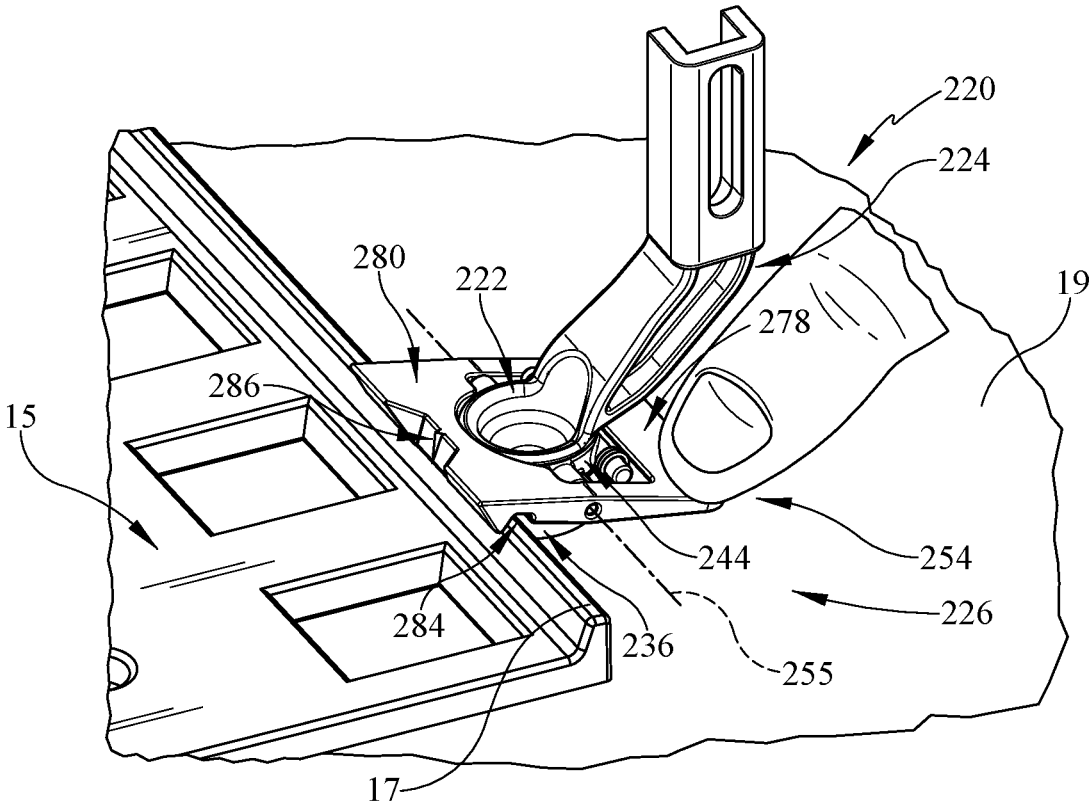
FIG. 10 is a perspective view of the hopping foot assembly of FIG. 8 showing the guide-attachment clip is configured to pivot relative to the guide-attachment body about a pivot axis between a disengaged position and an engaged position as shown in FIG. 11.
Figure 11:
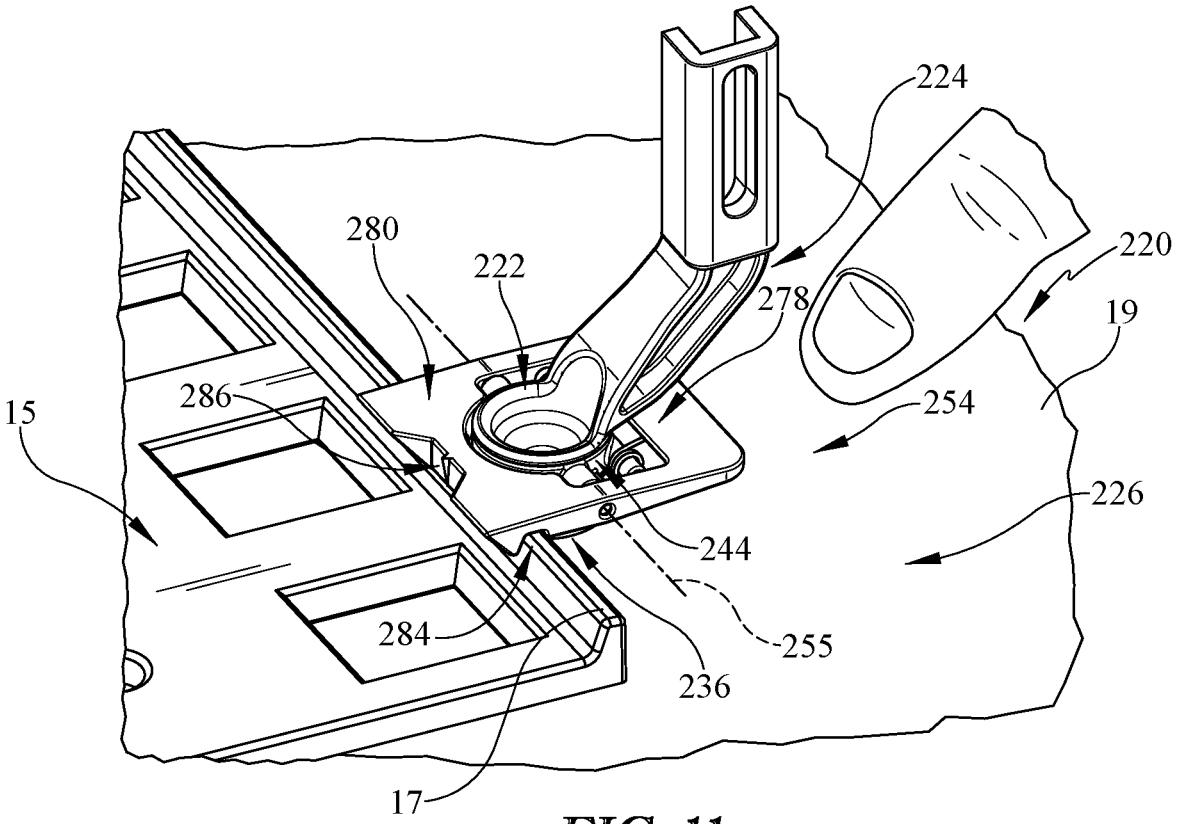
FIG. 11 is view similar to FIG. 10 showing the guide-attachment clip has changed to the engaged position in which the guide-attachment clip mates with the edge of the ruler to couple the rotating ruler guide to the ruler.

In the illustrative embodiment, the guide-attachment clip 254 is configured to pivot relative to the guide-attachment body 244 about a pivot axis 255 perpendicular to the axis 228 as shown in FIGS. 10 and 11. The guide-attachment clip 254 is configured to pivot between a disengaged arrangement as shown in FIG. 10 and an engaged arrangement as shown in FIG. 11.

To couple the rotating ruler guide 226 to the ruler 15, the user engages the guide-attachment clip 254 as suggested in FIG. 10. The user pushes down on a lever portion 278 of the guide-attachment clip 254 to cause the guide-attachment clip 254 to change to the disengaged arrangement. In the disengaged arrangement, the guide-attachment clip 254 is angled relative to the machine base 14 so that the groove 284 of the guide-attachment clip 254 is spaced apart from the ruler 15.

The space created under the guide-attachment clip 254 by angling with guide-attachment clip 254 allows the edge 17 of the ruler 15 to be arranged under the groove 284 of the guide-attachment clip 254. The user may then release the lever portion 278 of the guide-attachment clip 254 and the spring 256 biases the guide-attachment clip 254 into the engaged arrangement. In the engaged arrangement, the guide-attachment clip 254 is parallel with the machine base 14 so that the groove 284 engages with and couples to the edge 17 of the ruler 15.

To uncouple the rotating ruler guide 226 from the ruler 15, the user again engages the lever portion 278 to cause the guide-attachment clip 254 to change from the engaged arrangement to the disengaged arrangement. The space created under the guide-attachment clip 254 by angling with guide-attachment clip 254 allows the ruler 15 to be moved out from under the groove 284 of the guide-attachment clip 254. The user may then release the lever portion 278 of the guide-attachment clip 254 and the spring 256 biases the guide-attachment clip 254 into the engaged arrangement.

The guide-attachment body 244 includes cylinder portion 270, pin portions 272, 273, flanges 274, 275, and spring tabs 276, 277 as shown in FIG. 9. The cylinder portion 270 extends around the outer surface 230 of the hopping foot base 222 and couples to an outer race 240 of the bearing 236. The pin portions 272, 273 extend from the cylinder portion 270 opposite one another and couple to the guide-attachment clip 254. The flanges 274, 275 extend from the pin portions 272, 273. The flanges 274, 275 are configured to engage the guide-attachment clip 254 to cause the guide-attachment clip 254 to change from the engaged arrangement to the disengaged arrangement. The spring tabs 274, 275 extend from the cylinder portion 270 and form the attachment locations for the spring 256.

In the illustrative embodiment, the guide attachment 238 includes pins 258, 259 as shown in FIG. 9. The pins 258, 259 extend through the guide-attachment clip 254 and into the pin portions 272, 273 of the guide-attachment body 244. The pins 258, 259 extend along the pivot axis 255 and allow the guide-attachment clip 254 to pivot relative to the guide-attachment body 244.

The guide-attachment clip 254 includes the lever portion 278, a clip portion 280, and side portions 282, 283 as shown in FIGS. 9-13. The lever portion 278 is configured to be engaged by the user to cause the guide-attachment clip 254 to change between the engaged arrangement and the disengaged arrangement. The clip portion 280 is configured to engage with the edge 17 of the ruler 15 to couple the rotating ruler guide 226 to the ruler 15. The side portions 282, 283 extend between and interconnect the lever portion 278 and the clip portion 280.

In the illustrative embodiment, the pins 258, 259 extend through the side portions 282, 283 of the guide-attachment clip 254 and into the pin portions 272, 723 of the guide-attachment body 244. The first pin 258 extends through the side portion 282 and into the pin portion 272 on one side of the guide attachment 238. The second pin 259 extends through the side portion 283 and into the pin portion 273 on the opposite side of the guide attachment 238.

In the illustrative embodiment, the clip portion 280 of the guide-attachment clip 254 includes the groove 284 and a pointer 286 as shown in FIGS. 9-13. The groove 284 extends into a bottom surface of the clip portion 280 that faces the machine bed 14 and/or the fabric 19. The groove 284 extends between the side portions 282, 283. The pointer 286 extends into an edge 287 of the clip portion 280 in the illustrative embodiment. In other embodiments, the pointer 286 may extends from the edge 287 toward the ruler 15.

The pointer 286 is configured to be aligned with measurement indicators 23 formed in the ruler 15. In this way, the user may sew a stitch in the fabric 19 with a predetermined length.

Figure 12:
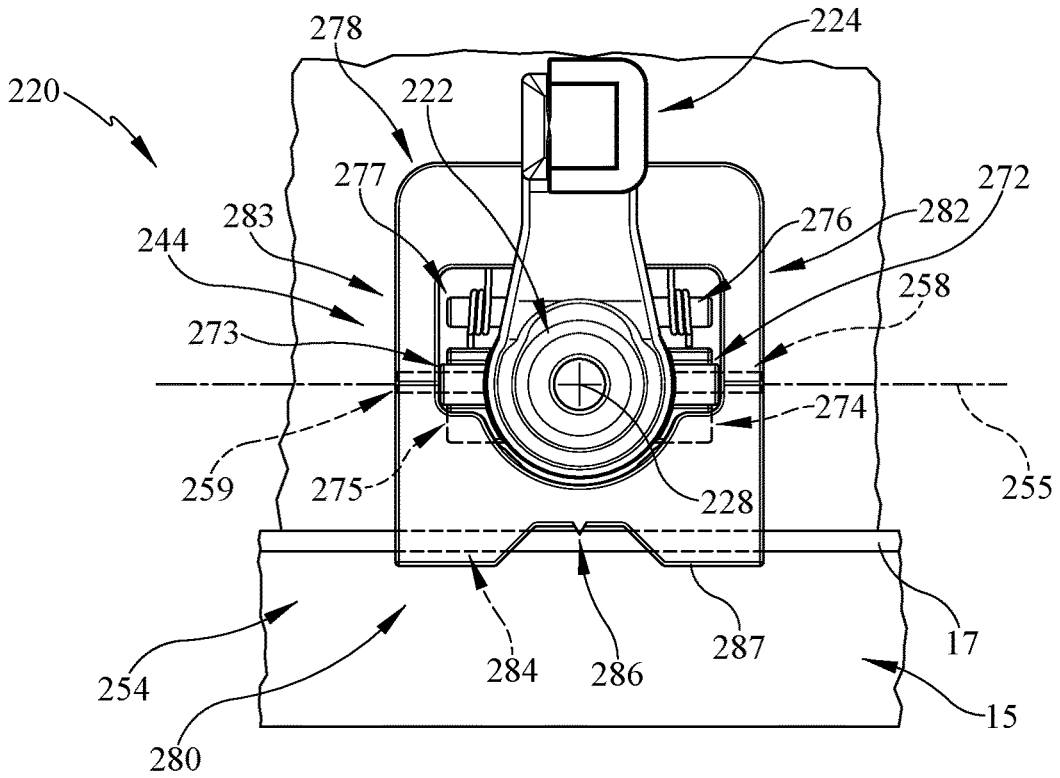
FIG. 12 is a top view of the hooping foot assembly of FIG. 8 showing the rotating ruler guide coupled to the edge of the ruler in a first position.

In the illustrative embodiment, the attachment clip 254 is coupled to the edge 17 of the ruler 15 so that the edge 17 of the ruler 15 is arranged in the groove 284. The ruler 15 is arranged in a first position as shown in FIG. 12, in which the ruler 15 extends horizontally.

Figure 13:
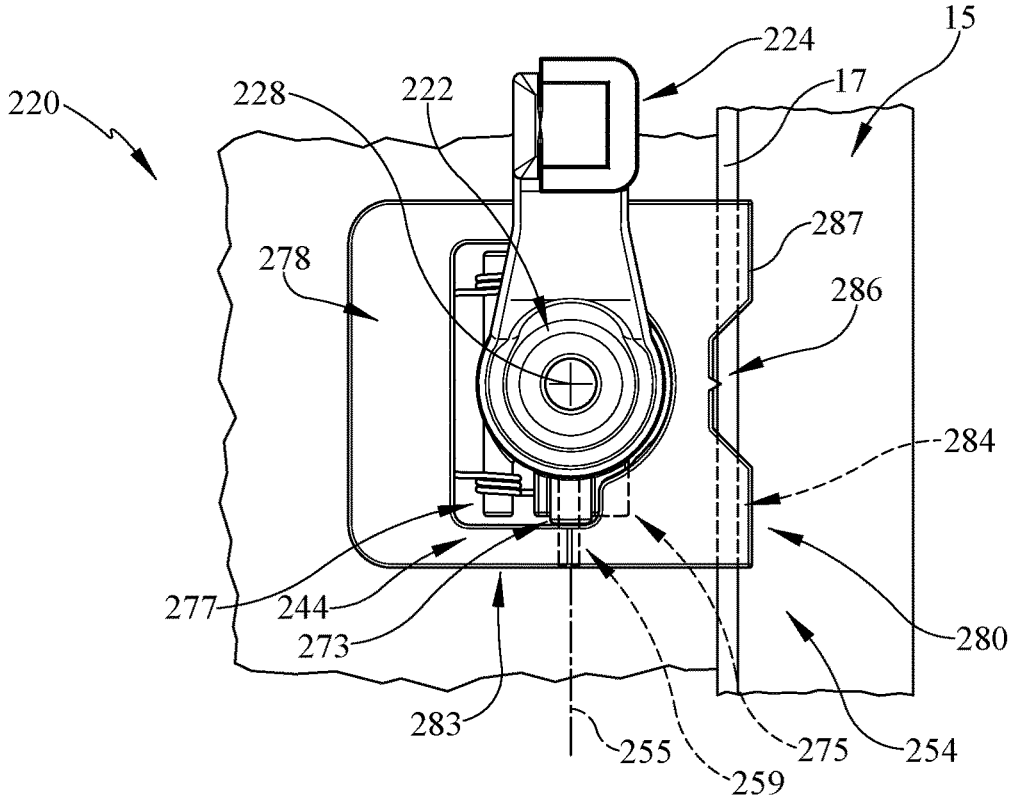
FIG. 13 is a view similar to FIG. 12 showing the rotating ruler guide coupled to the edge of the ruler in a second position, which has caused the rotating ruler guide to rotate from the first position.

If the path 21 changes direction, i.e. the user wants/needs to sew a different seam, ditch line, or pattern line, the user may adjust the position of the ruler 15 as suggested in FIG. 13. To adjust the position of the ruler 15, the user moves the ruler 15, which causes the rotating ruler guide 226 to rotate. The ruler 15 is moved until the edge 17 of the ruler 15 defines the desired path 21 to be followed.

In the illustrative embodiment, the ruler 15 is moved from the first position to a second position as shown in FIG. 13. In the second position, the ruler 15 extends vertically. In other embodiments, the ruler 15 may be arranged at an angle relative to the first position and/or the second position. The angle may vary as the rotating ruler guide 226 is configured to rotate 360 degrees about the axis 228.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A hopping foot assembly for a sewing machine having a needle, the hopping foot assembly comprising:

a circular hopping foot base shaped to include an outer surface and an inner surface that defines a needle opening that extends axially therethrough relative to an axis to allow the needle to extend into and out of fabric during use of the sewing machine, a hopping foot arm that extends axially from the hopping foot base relative to the axis and configured to be coupled to the sewing machine to fix the hopping foot base relative to the sewing machine, and a rotating ruler guide coupled to the outer surface of the hopping foot base and configured rotate about the axis relative to the hopping foot base, wherein the rotating ruler guide is configured to engage an edge of a ruler that defines a path and rotate to maintain engagement with the edge of the ruler to allow a user to follow the path with the needle of the sewing machine during use of the sewing machine, wherein the rotating ruler guide comprises:

a bearing separate from and coupled to the outer surface of the hopping foot base and configured to rotate about the axis, and a guide attachment separate from and coupled to the bearing and configured to engage the edge of the ruler so as to align the needle with the path.

2. The hopping foot assembly of claim 1, wherein the guide attachment comprises:

a guide-attachment body shaped to include a top side surface, a bottom side surface opposite the top side surface, and a plurality of lateral edge surfaces that extend between and interconnect the top and bottom side surfaces, and a plurality of guide-attachment tabs that each extend from one of the plurality of lateral edge surfaces of the guide-attachment body.

3. The hopping foot assembly of claim 1 or claim 2, wherein the bearing includes an outer race, an inner race, and a roller located between the outer race and the inner race, the hopping foot base is coupled to the inner race of the bearing, and the guide attachment is coupled to the outer race of the bearing.

4. The hopping foot assembly of claim 1, wherein the guide attachment is configured to couple to the edge of the ruler to fix the guide attachment relative to the ruler.

5. The hopping foot assembly of claim 1 or claim 4, wherein the guide attachment comprises:

a guide-attachment body coupled to the bearing, a guide-attachment clip coupled to the guide-attachment body and configured to pivot relative to the guide-attachment body about a pivot axis that is perpendicular to the axis, the guide-attachment clip shaped to define a groove that mates with the edge of the ruler to couple the rotating ruler guide to the ruler, and a spring located between the guide-attachment body and the guide-attachment clip and configured to bias the guide-attachment clip into engagement with the edge of the ruler.

6. The hopping foot assembly of claim 5, wherein the guide-attachment clip includes a pointer configured to be aligned with measurement indicators formed in the ruler so that the user may sew a stitch in the fabric with a predetermined length.

7. A hopping foot assembly for a sewing machine having a needle, the hopping foot assembly comprising:

a hopping foot base shaped to include a needle opening that extends axially therethrough relative to an axis, a hopping foot arm that extends from the hopping foot base and configured to be coupled to the sewing machine to fix the hopping foot base relative to the sewing machine, and a rotating ruler guide coupled to the hopping foot base and configured rotate about the axis relative to the hopping foot base, wherein the rotating ruler guide is configured to engage an edge of a ruler that defines a path and rotate to maintain engagement with the edge of the ruler during use of the sewing machine, wherein the rotating ruler guide comprises:

a guide-attachment body shaped to include a top side surface, a bottom side surface opposite the top side surface, and a plurality of lateral edge surfaces that extend between and interconnect the top and bottom side surfaces, the guide-attachment body configured to engage the ruler so as to align the needle with the path, and a plurality of guide-attachment tabs that each extend from one of the plurality of lateral edge surfaces of the guide-attachment body, the plurality of guide-attachment tabs includes a first tab that extends from a first edge surface included in the plurality of lateral edge surfaces, a second tab that extends from a second edge surface included in the plurality of lateral edge surfaces, a third tab that extends from a third edge surface in an opposite direction as the first tab, and a fourth tab that extends from a fourth edge surface in an opposite direction as the second tab.

8. A hopping foot assembly for a sewing machine having a needle, the hopping foot assembly comprising:

a hopping foot base shaped to include a needle opening that extends axially therethrough relative to an axis, a hopping foot arm that extends from the hopping foot base and configured to be coupled to the sewing machine to fix the hopping foot base relative to the sewing machine, and a rotating ruler guide coupled to the hopping foot base and configured rotate about the axis relative to the hopping foot base, wherein the rotating ruler guide is configured to engage an edge of a ruler that defines a path and rotate to maintain engagement with the edge of the ruler during use of the sewing machine, wherein rotating ruler guide comprises:

a guide-attachment body, a guide-attachment clip coupled to the guide-attachment body and configured to pivot relative to the guide-attachment body about a pivot axis that is perpendicular to the axis, the guide-attachment clip shaped to define a groove that mates with the edge of the ruler to couple the rotating ruler guide to the ruler, and a spring located between the guide-attachment body and the guide-attachment clip and configured to bias the guide-attachment clip into engagement with the edge of the ruler.

9. A hopping foot assembly for a sewing machine having a needle, the hopping foot assembly comprising:

a ruler, and a hopping foot base shaped to define a needle opening that extends axially therethrough relative to an axis to allow the needle to extend into and out of fabric during use of the sewing machine, a hopping foot arm that extends axially from the hopping foot base relative to the axis and configured to be coupled to the sewing machine to fix the hopping foot base relative to the sewing machine, and a rotating ruler guide coupled to the hopping foot base and configured rotate about the axis relative to the hopping foot base, wherein the rotating ruler guide is configured to engage an edge of the ruler that defines a path and rotate to maintain engagement with the edge of the ruler to allow a user to follow the path with the needle of the sewing machine during use of the sewing machine.

10. The hopping foot assembly of claim 9, wherein the rotating ruler guide comprises:

a guide-attachment body shaped to include a top side surface, a bottom side surface opposite the top side surface, and a plurality of lateral edge surfaces that extend between and interconnect the top and bottom side surfaces, the guide-attachment body configured to engage the ruler so as to align the needle with the path, and a plurality of guide-attachment tabs that each extend from one of the plurality of lateral edge surfaces of the guide-attachment body.

11. The hopping foot assembly of claim 9, wherein the rotating ruler guide comprises:

a bearing coupled to the hopping foot base and configured to rotate about the axis, and a guide attachment coupled to the bearing and configured to engage the ruler so as to align the needle with the path.

12. The hopping foot base of claim 11, wherein the guide attachment comprises:

a guide-attachment body coupled to the bearing and shaped to include a plurality of lateral edge surfaces, and a plurality of guide-attachment tabs that each extend from one of the plurality of lateral edge surfaces of the guide-attachment body.

13. The hopping foot assembly of claim 11, wherein the guide attachment comprises:

a guide-attachment body coupled to the bearing, a guide-attachment clip coupled to the guide-attachment body and configured to pivot relative to the guide-attachment body about a pivot axis that is perpendicular to the axis, the guide-attachment clip shaped to define a groove that mates with the edge of the ruler to couple the rotating ruler guide to the ruler, and a spring located between the guide-attachment body and the guide-attachment clip and configured to bias the guide-attachment clip into engagement with the edge of the ruler.

14. The hopping foot assembly of claim 13, wherein the guide-attachment clip includes a pointer configured to be aligned with measurement indicators formed in the ruler so that a user may sew a stitch in the fabric with a predetermined length.

15. The hopping foot assembly of any one of claims 11 to 14, wherein the bearing includes an outer race, an inner race, and a roller located between the outer race and the inner race, the hopping foot base is coupled to the inner race of the bearing, and the guide attachment is coupled to the outer race of the bearing.

16. The hopping foot assembly of claim 11, wherein the guide attachment is configured to couple to the edge of the ruler to fix the guide attachment relative to the ruler.

17. The hopping foot assembly of claim 9, wherein rotating ruler guide comprises:

a guide-attachment body, a guide-attachment clip coupled to the guide-attachment body and configured to pivot relative to the guide-attachment body about a pivot axis that is perpendicular to the axis, the guide-attachment clip shaped to define a groove that mates with the edge of the ruler to couple the rotating ruler guide to the ruler, and a spring located between the guide-attachment body and the guide-attachment clip and configured to bias the guide-attachment clip into engagement with the edge of the ruler.

* * * * *